United States Patent [19]

James

[11] Patent Number: 4,463,689

[45] Date of Patent: Aug. 7, 1984

[54] HIGH TEMPERATURE FURNACE NOSE CONSTRUCTION

[75] Inventor: Barry R. James, Apple River, Ill.

[73] Assignee: Merkle Engineers, Inc., Galena, Ill.

[21] Appl. No.: 337,846

[22] Filed: Jan. 7, 1982

[51] Int. Cl.[3] ..... F23M 5/06

[52] U.S. Cl. ..... 110/334; 52/127.1; 52/249; 52/486; 110/331; 110/336; 110/339; 266/280; 432/247

[58] Field of Search ..... 110/331, 334, 335, 336, 110/338, 339, 340; 432/238, 247; 266/280, 281, 283, 286; 52/127.1, 249, 486

[56] References Cited

U.S. PATENT DOCUMENTS

| | | | |
|---|---|---|---|
| 1,582,275 | 4/1926 | Kellner | 110/334 |
| 1,636,603 | 7/1927 | Hamilton | 110/334 |
| 2,158,759 | 5/1939 | Morlock | 110/331 |

*Primary Examiner*—Henry C. Yuen
*Assistant Examiner*—Steven E. Warner
*Attorney, Agent, or Firm*—Thomas W. Speckman

[57] ABSTRACT

A suspended nose construction for high temperature furnaces providing refractory replacement from the cold side of the refractory has a plurality of wedge-shaped refractories arranged to form a wedge row along the length of the nose adjacent, on at least one side, a plurality of rectangular-shaped refractories arranged to form a straight row along the length of the nose. The converging sides of the wedge-shaped refractories converge toward the cold side of the refractory. Both the wedge refractories and the rectangular refractories are suspended in pairs by suspension means from an exterior support structure, the suspension means and support structure providing space allowing removal of the refractories in pairs from the cold side of the nose construction. The suspended nose construction according to this invention provides for removal and replacement of a small number of refractories in the nose without disturbing the major portion of the nose construction. The suspended nose construction of this invention provides for replacement of nose refractories from the cold side of the furnace enabling continued operation of the furnace during most nose repairs.

10 Claims, 2 Drawing Figures

HIGH TEMPERATURE FURNACE NOSE CONSTRUCTION

BACKGROUND OF THE INVENTION

This invention relates to nose construction for high temperature furnaces, and more particularly to a suspended nose construction which provides refractory replacement from the cold side of the refractory. High temperature furnaces may include a curved wall portion known as fantail turn or nose construction which makes the transition between a vertical wall and a suspended horizontal roof, or between two walls having some other angular relationship to each other. The nose constructions to which this invention relate have their center of radius outside the cold side of the furnace.

Nose constructions have been generally made of a number of wedge-shaped refractory bricks having one set of opposing converging sides which converge toward the cold side of the nose construction, as exemplified by U.S. Pat. Nos. 1,636,603, 1,764,707, 2,132,517, 2,272,015 and 2,685,264. U.S. Pat. No. 1,582,275 discloses a hanging arch for furnaces which is constructed of wedge-shaped bricks, some arranged with their sides converging toward the cold side and some with their sides converging toward the hot side. However, it is clear that repair must be made from the inside of the furnace taught by the 1,582,275 patent and that the furnace must be shut down for such repair.

Despite advances in the art of refractory design, prolonged exposure to the extremely high temperatures to which refractories are subjected eventually wears or cracks the bricks. In order to repair the nose or replace individual bricks in the nose constructions described in the above patents, the furnace must be shut down so that workmen may remove the wedge-shaped bricks from the inside of the furnace. This is expensive and time-consuming, and would not be necessary if the individual bricks could be removed from the cold side of the furnace. The refractory bricks used in nose constructions for high temperature furnaces are generally suspended from the cold side of the furnace. The suspension systems described in the patents referred to above generally do not permit removal and replacement of bricks from the cold side of the furnace.

There is a need for a suspended nose construction for high temperature furnaces which provides for replacement of refractory bricks from the cold side of the furnace, and includes suspension means which facilitates such removal and replacement.

SUMMARY OF THE INVENTION

Accordingly, an object of this invention is to provide a nose construction for high temperature furnaces which provides for refractory replacement in the nose from the cold side of the furnace, while the furnace is in operation.

Another object is to provide a nose construction which permits easy removal and replacement of a small number, as low as two, refractory bricks from the cold side of the furnace.

Yet another object is to provide a suspended nose construction having rows of bricks which are offset so that a portion of some of the rows may be removed without collapsing other portions of the nose construction.

Another object is to provide suspended nose constructions adaptable to various radii in angular increments or arcs of as little as 15°, if desired.

In one embodiment of this invention, a suspended nose construction in a high temperature furnace providing refractory replacement from the cold side of the refractory has a plurality of wedge-shaped refractories arranged to form a wedge row along the length of the nose adjacent a plurality of rectangular-shaped refractories arranged to form a straight row along the length of the nose. Each wedge-shaped refractory has one set of opposing parallel sides and one set of opposing converging sides converging toward the cold side of the wedge-shaped refractory. The wedge-shaped refractories are arranged with their parallel sides adjacent to each other to form the wedge row. The rectangular-shaped refractories have two sets of opposing parallel sides, one of which is adjacent one of the converging sides of at least one of the wedge-shaped refractories. Both the wedge refractories and rectangular refractories are suspended in pairs by suspension means which permit the refractories to be withdrawn from the cold side of the furnace.

BRIEF DESCRIPTION OF THE DRAWING

The above mentioned and other features of this invention and the manner of obtaining them will become more apparent, and the invention itself will be best understood by reference to the following description of preferred embodiments of the invention taken in conjunction with the accompanying drawings in which.

DESCRIPTION OF THE PREFERRED EMBODIMENTS

Figure 1:
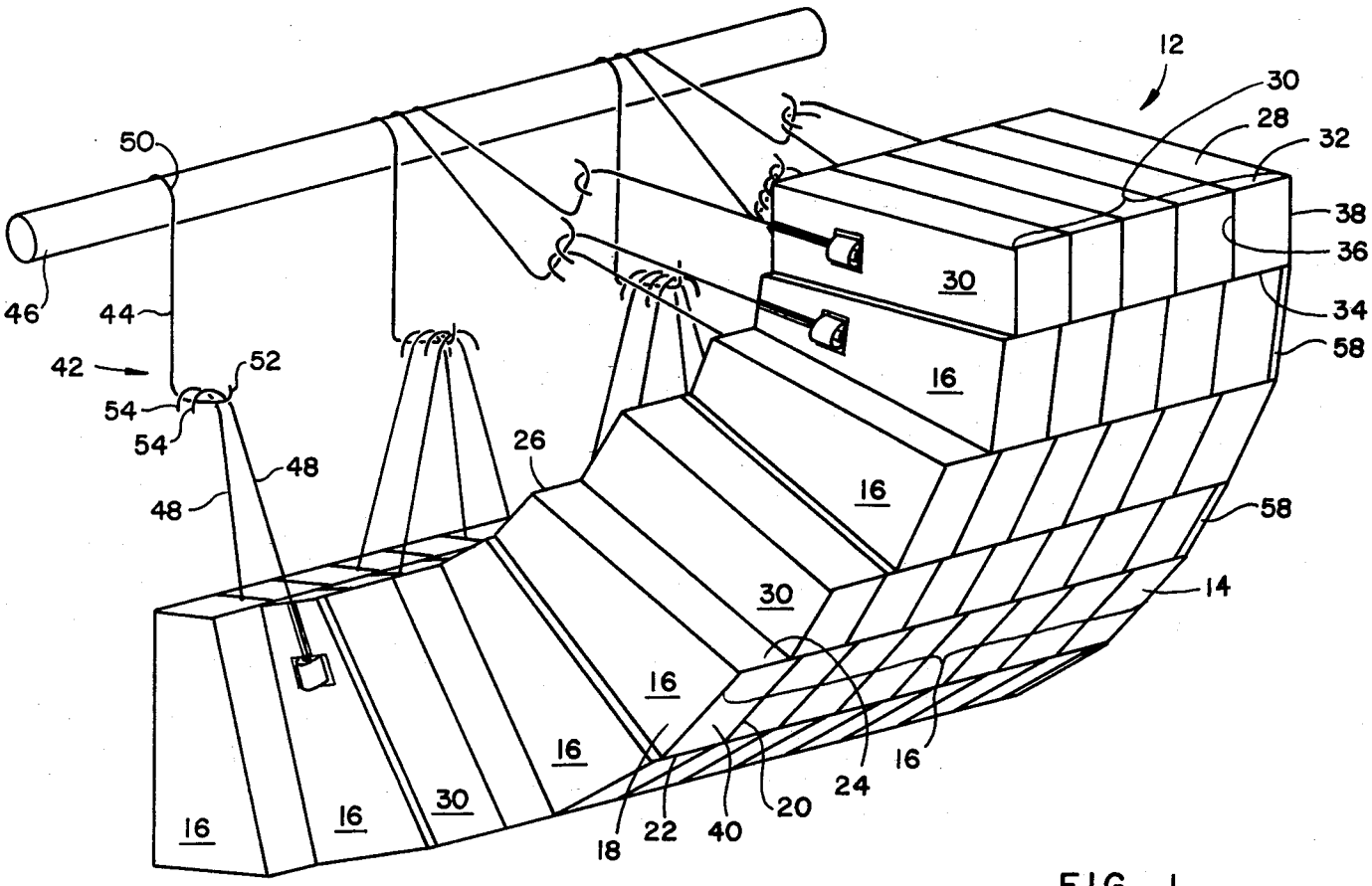
FIG. 1 is a perspective view of a portion of the nose construction of one embodiment of this invention.

A portion of a nose construction for a high temperature furnace is shown in FIG. 1. The nose construction 12 includes a plurality of wedge-shaped refractory bricks 14 arranged to form a wedge row 16 which extends generally along the length of the nose construction 12. Several wedge rows 16 may be included in the nose construction, as required by the desired nose arc length and the design of the furnace.

Each wedge-shaped refractory has one set of opposing parallel sides 18, 20, and one set of opposing converging sides 22, 24, which converge toward a cold side 26 of the wedge refractories 14. Wedge refractories 14 are arranged with their parallel side 18 adjacent the parallel side 20 of the adjacent brick 14, to form the wedge row 16.

A plurality of rectangular-shaped refractories 28 are arranged to form straight row 30 along the length of the nose construction 12. Each rectangular-shaped refractory 28 has a first set of opposing parallel sides 32, 34, and a second set of opposing parallel sides 36, 38. At least one parallel side of each rectangular refractories is adjacent to a converging side of a wedge refractory.

Wedge refractories 14 and rectangular refractories 28 may be the same or different widths. The refractories in wedge row 16 and the refractories in straight row 30 may be in vertical alignment, or may preferably be offset, as shown in FIG. 1. The hot faces 40 and cold faces 26 of the wedge refractories and the rectangular refractories are shaped to provide the desired hot surface and cold surface, respectively.

Each of the wedge refractories 14 and rectangular refractories 28 are suspended in pairs by a suspension means 42. As shown in the figures, the suspension means has hanger rod 44 suspended from support structure 46 at one end and refractory hanger 48 suspended from hanger rod 44 at the other end. The other end of refractory hanger 48 suspends one pair of the refractories. The distance between the refractories and support structure 46 is sufficient to allow easy withdrawal of the refractories from the nose construction. While the figures show two or four refractory hangers 48 attached to each hanger rod 44, a greater or lesser number of refractory hangers may be suspended from each hanger rod, or the refractory hangers may extend to support structure 46 and hanger rods 44 omitted when a small number of refractories are used, such as in a small arc. To most clearly show the means of hanging refractories, FIG. 1 omits several suspension means 42 for suspension of refractories which are shown. Any suitable suspension means suspending individual refractories from support structure 46 may be used as long as they permit placement and removal of the individual refractories.

Figure 2:
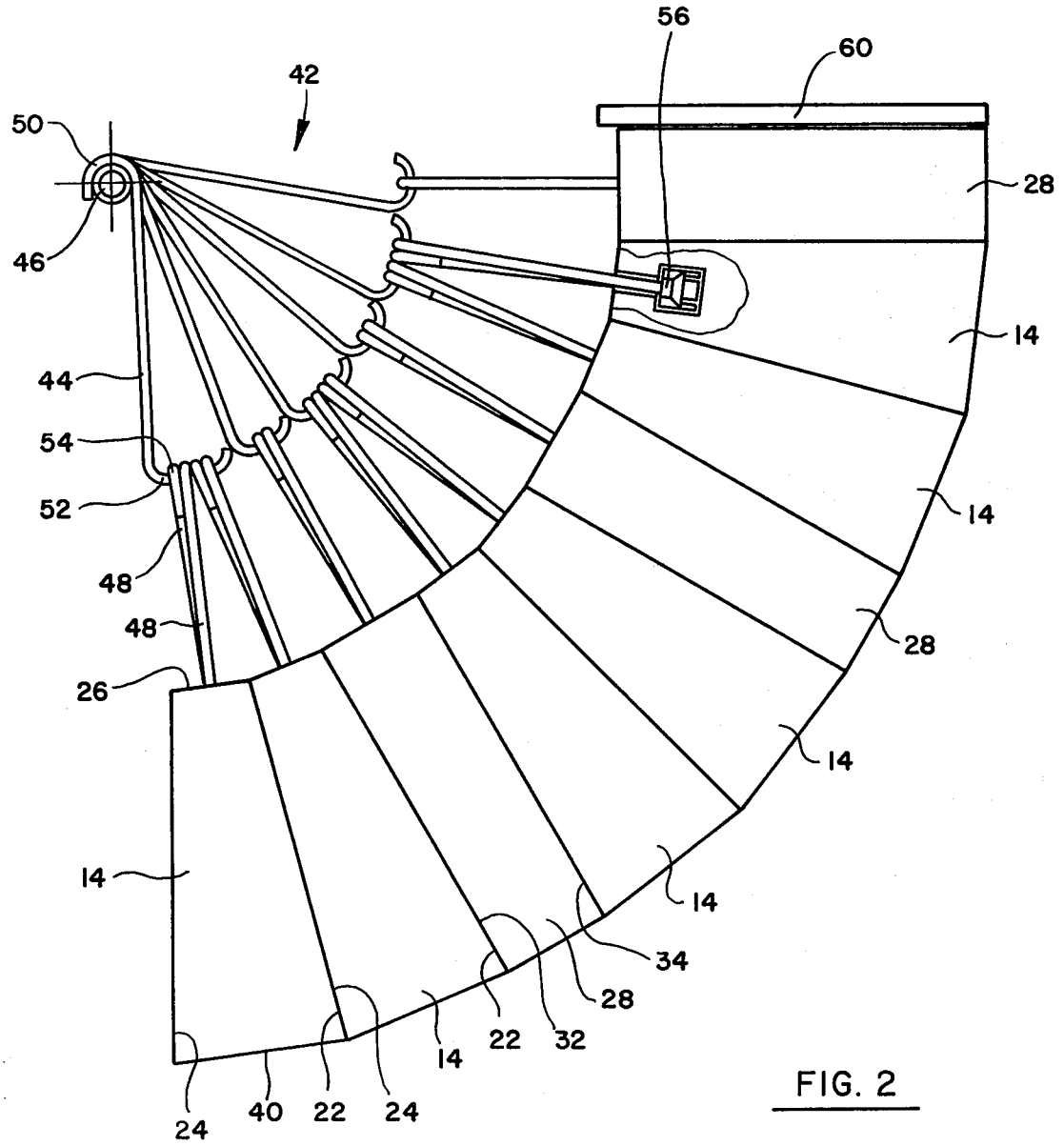
FIG. 2 is an end view of the nose construction of FIG. 1.

In a preferred embodiment, hanger rod 44 is suspended from support structure 46 by a hook 50 or any other suitable means, and refractory hanger 48 may be suspended from hanger rod 44 by hook 52 on hanger rod 44 and hook 54 on refractory hanger 48. Hanger rods 44 and refractory hangers 48 may be metal of round or other cross section, and may be of any length required for a specific installation, provided that support structure 46, adjacent refractory hangers 48 and adjacent hanger rods 44 do not interfere with removal of refractories from the cold face of the furnace. Refractories may be suspended from refractory hangers by any suitable securing means 56, as shown in FIG. 2. The securing means 56 may be similar to that shown in U.S. Pat. No. 4,073,243, incorporated herein by reference, if desired.

While it is contemplated that some nose constructions may join furnace walls inclined at angles as small as about 15°, using only one wedge row and one straight row, the nose construction may be used to join walls inclined up to about 90° with respect to each other. In such applications, the straight rows may be interspersed among the wedge rows as necessary. A straight row 30 may be placed adjacent each wedge row 16, or two adjacent wedge rows 16, as shown in FIGS. 1 and 2. The refractories of adjacent rows may be in alignment with each other, or may be offset so that the bricks overlap, as shown in FIG. 1. If the refractories overlap, the nose construction will be supported when individual refractories are removed. In such cases, cut refractories 58 may be used to complete the end of the nose construction.

A nose construction may be constructed according to this invention by assembling the refractories as shown in FIG. 1. A shelf 60, as shown in FIG. 2, is independently supported and supports the vertical wall of refractories above the nose construction 12. When a single refractory or section of refractories in the nose construction becomes worn or cracked, they may easily be replaced from the cold side of the furnace. A pair of rectangular refractories 28 may be easily removed by pulling their refractory hanger 48 away from the furnace, disconnecting them from the hanger rod 44, and removing refractories 28. The rectangular refractories may be replaced by reversing the above procedure.

Defective wedge refractories 14 may be removed easily in the same manner as the rectangular refractories after one or more adjacent rectangular refractories 28 have been removed. The wedge refractories may be replaced by reversing the procedure. If more than one wedge row 16 is placed beneath the adjacent straight row 30, refractories in intervening wedge rows 16 must be removed as required to reach the defective wedge refractories. Thus, any pair of refractories or section of refractories may be easily replaced by removal of a small number of refractories from the cold side of the furnace, while the furnace is in operation.

The advantages of this invention are now self-apparent. A small number of refractories, as few as two, or whole portions of the nose construction of high temperature furnaces may be removed and replaced easily from the cold side of the furnace while the furnace is in operation, which saves fuel and time. The suspension system of this invention further facilitates the easy removal and replacement of refractories in the nose construction.

The refractories for use in the nose construction of this invention may be manufactured from materials and by processes known to the art which will be apparent upon reading this disclosure. Likewise, the suspension means may be manufactured from materials and according to end suspension designs known to the art which will be apparent upon reading this disclosure.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In a high temperature furnace constructed of refractories, curved nose construction having its center of radius of curvature outside the cold side of said furnace and said refractories suspended from a support structure providing refractory replacement from the cold side of said refractories comprising:

a plurality of adjacent wedge-shaped refractories arranged to form a wedge row along the length of said nose, each said wedge refractory having one set of opposing parallel sides and one set of opposing converging sides converging toward said cold side of said wedge refractory, said wedge refractories arranged with their parallel sides adjacent to form said wedge row;

a plurality of adjacent rectangular-shaped refractories arranged to form a straight row along the length of said nose, each said rectangular refractory having two sets of opposing parallel sides, one of said parallel sides adjacent one of said converging sides of at least one of said wedge refractories;

each pair of two adjacent of said wedge refractories in each said wedge row independently suspended from said support structure by suspension means and each pair of two adjacent of said rectangular refractories in each said straight row independently suspended from said support structure by suspension means, said suspension means and support structure providing space allowing removal of each of said pair of refractories from said cold side of said curved nose construction; and a plurality of said wedge rows and a plurality of said straight rows, at least one of said straight rows adjacent each said wedge row forming said curved nose construction.

2. The furnace construction of claim 1 comprising two adjacent wedge rows between said straight rows, one set of opposing converging sides of said wedge refractories in said one adjacent wedge row being adjacent one set of opposing converging sides of said wedge refractories in said other adjacent wedge row.

3. The furnace construction of claim 2 wherein said refractories in one said one adjacent wedge are offset so as to be out of vertical alignment with said refractories of said other adjacent wedge row.

4. The furnace construction of claim 1 wherein said refractories in one row are offset so as to be out of vertical alignment with said refractories of adjacent rows.

5. The furnace construction of claim 1 wherein the distance between said opposing parallel sides of said wedge refractories and the distance between at least one set of said opposing parallel sides of said rectangular refractories is the same dimension.

6. The furnace construction of claim 5 wherein adjacent rows of said wedge refractories and said rectangular refractories are in alignment.

7. The furnace construction of claim 1 wherein said suspension means comprises a hanger rod suspended from said support structure and a refractory hanger suspended from said hanger rod, said refractory hanger suspending a pair of refractories.

8. The furnace construction of claim 7 wherein two to four of said refractory hangers are suspended from each said hanger rod.

9. In a high temperature furnace constructed of refractories, curved nose construction having its center of radius of curvature outside the cold side of said furnace and said refractories suspended from a support structure providing refractory replacement from the cold side of said refractories comprising:

a plurality of adjacent wedge-shaped refractories arranged to form a wedge row along the length of said nose, each said wedge refractory having one set of opposing parallel sides and one set of opposing converging sides converging toward said cold side of said wedge refractory, said wedge refractories arranged with their parallel sides adjacent to form said wedge row;

a plurality of adjacent rectangular-shaped refractories arranged to form a straight row along the length of said nose, each said rectangular refractory having two sets of opposing parallel sides, one of said parallel sides adjacent one of said converging sides of at least one of said wedge refractories;

each pair of two adjacent of said wedge refractories in each said wedge row independently suspended from said support structure by suspension means and each pair of two adjacent of said rectangular refractories in each said straight row independently suspended from said support structure by suspension means comprising a hanger rod suspended from said support structure and a refractory hanger suspended from said hanger rod, said hanger rod comprising a first hook over said support structure on one end and a second hook for suspending said hanger on the other end, said refractory hanger comprising a hook engaging said second hook at one end and means for suspending said refractory pair from said hanger at the other end, said suspension means and support structure providing space allowing removal of each said pair of refractories from said cold side of said curved nose construction; and a plurality of said wedge rows and at least one said straight row adjacent each said wedge row forming said curved nose construction.

10. A method of removing a wedge-shaped refractory in a suspended curved nose construction having its center of radius of curvature outside the cold side of said furnace of the type having a plurality of adjacent wedge-shaped refractories arranged to form a wedge row along the length of the curved nose with the converging sides converging toward the cold side of the refractories and a plurality of adjacent rectangular-shaped refractories arranged to form a straight row along the length of the nose wherein a wedge row is adjacent a straight row on at least one side and each pair of two adjacent of said wedge refractories in each said wedge row independently suspended from said support structure by suspension means and each pair of two adjacent of said rectangular refractories in each said straight row are independently suspended from a support structure by suspension means and spaced to allow removal of each said pair of refractories from said cold side of said suspended curved nose construction and a plurality of said wedge rows and a plurality of said straight rows, at least one of said straight rows adjacent each said wedge row forming said curved nose construction, said method comprising:

first removing at least one of said pairs of rectangular-shaped refractories toward the cold side of the refractories; and then removing at least one of said pairs of wedge-shaped refractories adjacent said removed rectangular-shaped refractories toward the cold side of the refractories.

* * * * *